US005996282A

United States Patent [19]

Giovannetti

[11] Patent Number: 5,996,282

[45] Date of Patent: Dec. 7, 1999

[54] OPENING MECHANISM FOR COPLANAR DOORS

[76] Inventor: Antonio Giovannetti, Residenza Fontana Milan 2, Segrate, Italy

[21] Appl. No.: 08/906,205

[22] Filed: Aug. 5, 1997

[30] Foreign Application Priority Data

Aug. 5, 1996 [IT] Italy ..... MI96A1705

[51] Int. Cl.[6] ..... E05D 15/20

[52] U.S. Cl. ..... 49/130; 49/125; 49/128

[58] Field of Search ..... 49/125, 127, 128, 49/129, 130; 312/304, 301, 299

[56] References Cited

U.S. PATENT DOCUMENTS

| | | | |
|---|---|---|---|
| 3,293,801 | 12/1966 | Henning | 49/130 |
| 4,574,524 | 3/1986 | Bonetti et al. | 49/130 |
| 4,644,690 | 2/1987 | Caimi | 49/130 |
| 4,708,410 | 11/1987 | Mazaki | 49/127 X |
| 4,949,504 | 8/1990 | Bortoluzzi | 49/130 |
| 5,207,024 | 5/1993 | Edema et al. | 49/130 X |

FOREIGN PATENT DOCUMENTS

| | | |
|---|---|---|
| 75 364 | 3/1983 | European Pat. Off. . |
| 209 812 | 1/1987 | European Pat. Off. . |
| 0 291 564 | 11/1988 | European Pat. Off. . |
| 340 517 | 11/1989 | European Pat. Off. . |
| 761447 | 11/1956 | United Kingdom . |

*Primary Examiner*—Jerry Redman

*Attorney, Agent, or Firm*—Jacobson, Price, Holman & Stern, PLLC

[57] ABSTRACT

The mechanism comprises longitudinal rails and, for each door, a double slide assembly of which a first slide slides along the rails and a second slide, constrained to the door, moves at right angles to the first slide between a retracted position in which the door is closed and an extracted position in which the door is opened, at a distance from said first position at least equal to the thickness of the door or a multiple thereof. A longitudinal traverse of the slide assembly is allowed only when the second slide is in the extracted position with respect to the first. The retracted position is forced by spring means between the second slide and the first slide. The width of the slide assembly is smaller than the width of the door, generally being half, a third or a quarter thereof. In a wardrobe with a plurality of doors, the mechanism allows any one of the doors to be opened with exactly the same extracting and sliding movement; it also allows more than one compartment to be opened at the same time, in practice as many as all the doors of wardrobe but one, in front of which the doors are disposed parallel to each other.

12 Claims, 10 Drawing Sheets

OPENING MECHANISM FOR COPLANAR DOORS

BACKGROUND OF THE INVENTION

1. Field of the Invention

The invention relates to the field of furniture with so-called "coplanar" doors.

Furniture with so-called "coplanar" doors, in which opening of the doors takes place not by rotation around hinges with a vertical axis but by sliding of the doors one over the other, have recently met with considerable commercial success. This furniture has advantages as regards the space required for opening and especially aesthetic advantages. Various mechanisms currently exist to allow the sliding movement of the doors one over the other. These mechanisms generally comprise a slide running on longitudinal rails for one of the doors, which therefore is movable in a first plane, and a swinging support mounted on a sliding slide for a second door, which can therefore be swung and position itself for movement on a second plane parallel to said first plane.

2. Description of the Related Art

All these wardrobes have the disadvantage that the user must know which of the doors can be moved by sliding directly and which must be moved outwards to be able to slide. In practice, the operation that must be carried out for opening and therefore for closing differs from one door to the other.

A further drawback that is encountered in known wardrobes lies in the fact that, when a wardrobe has three or more compartments with the relative doors, the mechanisms allow access to only one compartment at a time, the other compartments remaining closed by their respective doors.

BRIEF SUMMARY OF THE INVENTION

The aim of the present invention is to overcome the above drawbacks.

In particular an aim is to create an opening mechanism for coplanar doors that can be operated with exactly the same maneuver on each of the wardrobe doors without the user having to think first which door is being operated and which maneuver has to be applied to that door.

Another aim is to create a mechanism by which, in a wardrobe with a plurality of coplanar doors, access can be gained simultaneously to more than one compartment of the wardrobe, in particular to all compartments but one, in front of which the doors are stacked.

These aims have been achieved with the mechanism of the present invention.

In other words, the new mechanism comprises a guide rail longitudinal to the wardrobe on which runs a slide assembly for each door, said assembly comprising a first slide with a longitudinal movement and a second slide with a transversal movement on the first slide. The second slide is constrained to the first slide by spring means and can take an extracted position with respect to the first slide and a retracted position thereon, the latter position being facilitated by the spring means. Only in said extracted position can the slide assembly be subjected to the longitudinal movement on the rail. In the retracted position, on the other hand, means integral with the second slide engage locking means on the rail to prevent sliding. The second slide is integral with a door. The width of each slide assembly or unit is smaller that the width of the door, in particular being a submultiple, i.e. half, one third or a quarter of the width of the door. To overcome any lack of balance which might arise from this arrangement, each first slide can be integral with a balancing bar extending inside the rail and guided therein.

When the second slide is in the extracted position with respect to the first, a guide means integral with the second slide engages a guide surface on the rail. The second slide carries a so-called "accompanying" locking element or strip, able to engage on locking members fixed on the rail when the slide assembly is in the retracted locked position. The locking strip and the guide wheel are preferably integral and the position on the second slide, which can be modified, makes it possible to establish the extent to which the second slide can be extracted with respect to the first slide, that is to say, for example, a distance about equal to the thickness of a door, double the thickness of a door or some other multiple of the thickness of the door.

The new mechanism allows wardrobes with coplanar doors to be made in which two, three or more doors can be moved parallel to each other and be positioned stacked one over the other so as to free one, two or more compartments of a wardrobe at the same time. A further advantage of the mechanism of the invention is that the operator moves each door in the same way, that is he first pulls it towards him and then pulls it sideways.

BRIEF DESCRIPTION OF THE SEVERAL VIEWS OF THE DRAWINGS

What is outlined above and the relative advantages will be made clear by the explanation of embodiments of the invention, shown purely by way of non-limiting example in the appended drawings, in which.

DETAILED DESCRIPTION OF THE INVENTION

Figure 1:
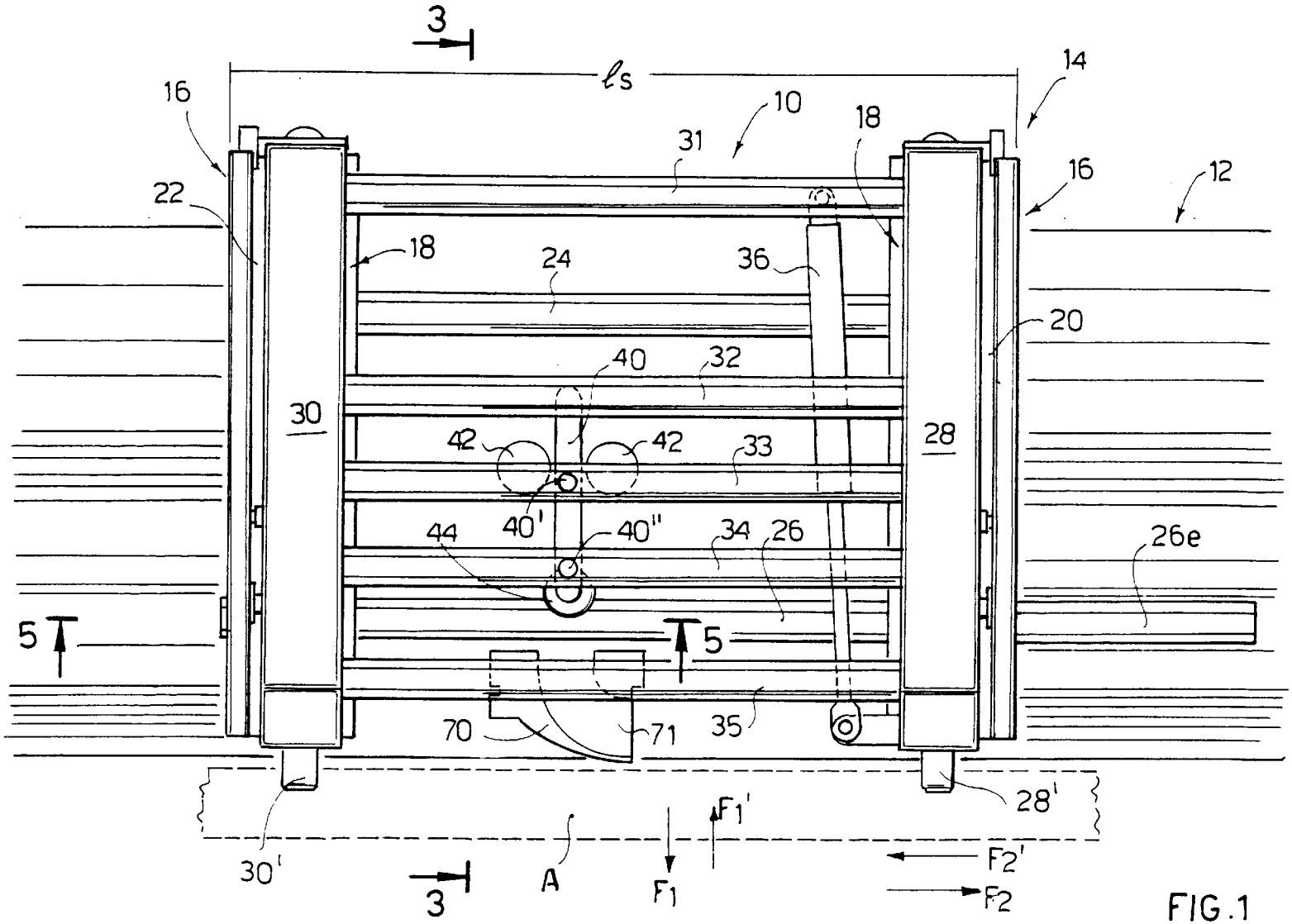
FIG. 1 is a top plan view of a mechanism according to the invention, with the rails shown interrupted to avoid excessive complications and a slide assembly in the retracted position with the door closed.
Figure 2:
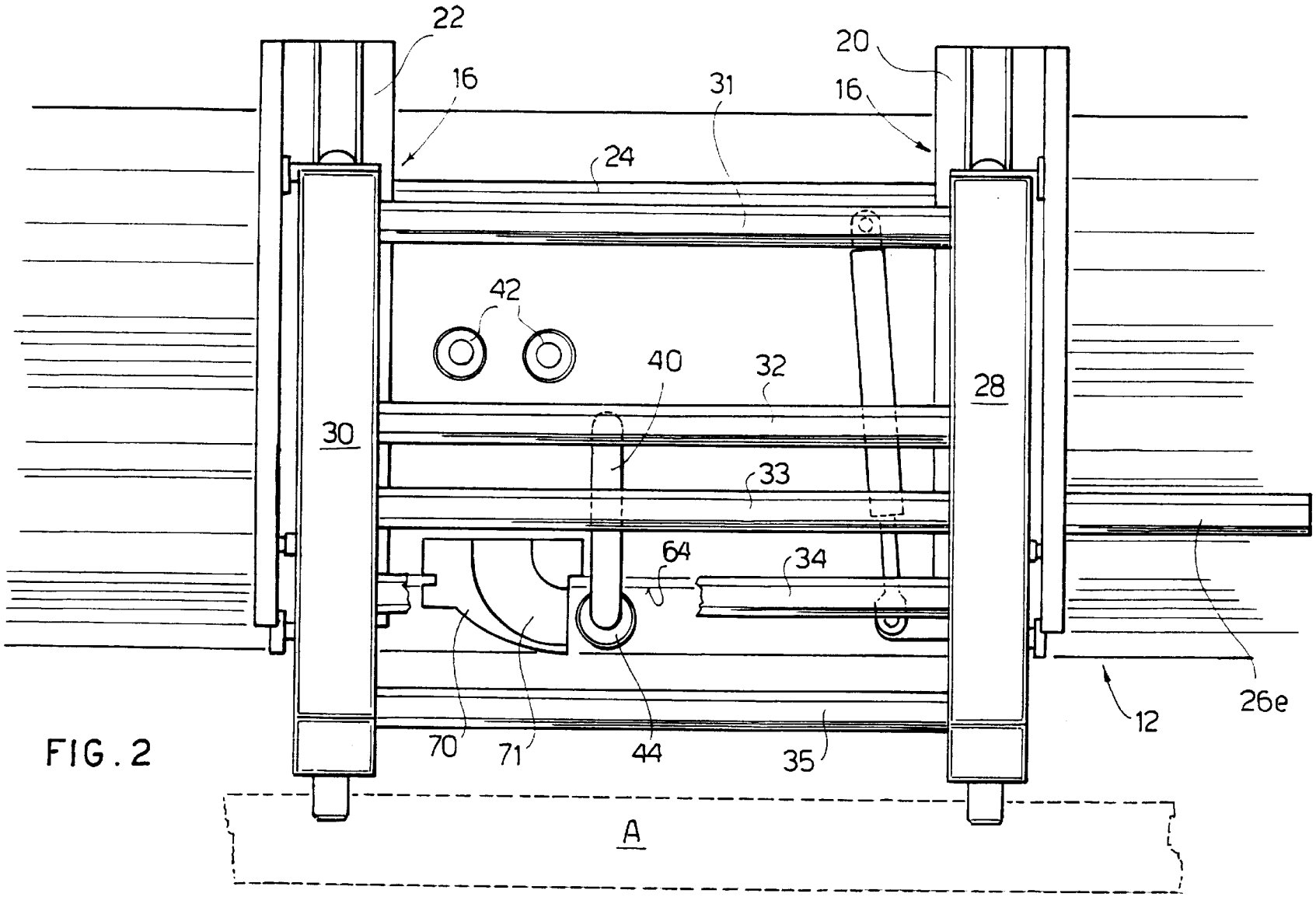
FIG. 2 is a plan view of the carriage assembly in FIG. 1 in the extended state, with the door during opening ready to slide sideways.

In the figures, the mechanism as a whole is indicated with reference number 10. It comprises a longitudinal guide rail indicated as a whole by 12, generally in the form of a section forming a plurality of parallel sliding tracks, which will be described in detail below with reference to the other figures. The rail is mounted longitudinally to a wardrobe or to spaces or openings in general that are to be closed with doors.

For each door A a slide assembly or unit indicated as a whole by 14 is mounted on the rail 12. The slide assembly 14 can slide longitudinally on the rail 12 and is held in a fixed position on it by means which will be described below. The slide assembly comprises a first slide 16 with a longitudinal movement along the rail and a second slide 18 carried by the first slide and moving on it transversally to the movement of the first slide. The first slide 16 is composed of two L-shaped sections 20, 22 transversal to the rail and arranged facing each other, connected to each other by cross members 24, 26. The second slide 18 comprises longitudinal members 28 and 30 opposite each other, each accommodated on the L-shaped cross members of the first slide and carrying respective pivots 28' and 30' at the front for fixing to a door A shown interrupted in FIG. 1. The longitudinal members 28 and 30 are connected by transversal rods in any number desired, as appropriate; in the figures five are shown, numbered 31, 32, 33, 34 and 35.

For the sake of convenience, the part of the mechanism facing towards the door and towards the user will be referred to as the front part. However, it is understood that this in no way limits the invention. Between the front part of the second slide 18 and the rear part of the first slide 16 a spring system, generally consisting of a gas spring 36, is mounted so as to return the second slide 18 into the retracted position on the slide 16 illustrated in FIG. 1. A stop to the longitudinal movement of the slide assembly along the rail 12 is provided by a so-called "accompanying" locking element, 40, mounted on the second slide, which engages between a pair of spaced wheels or bearings 42, 42 mounted on the rail. The second slide 18 also has a wheel or guide element 44 applied to it, preferably applied to the element 40.

Figure 3:
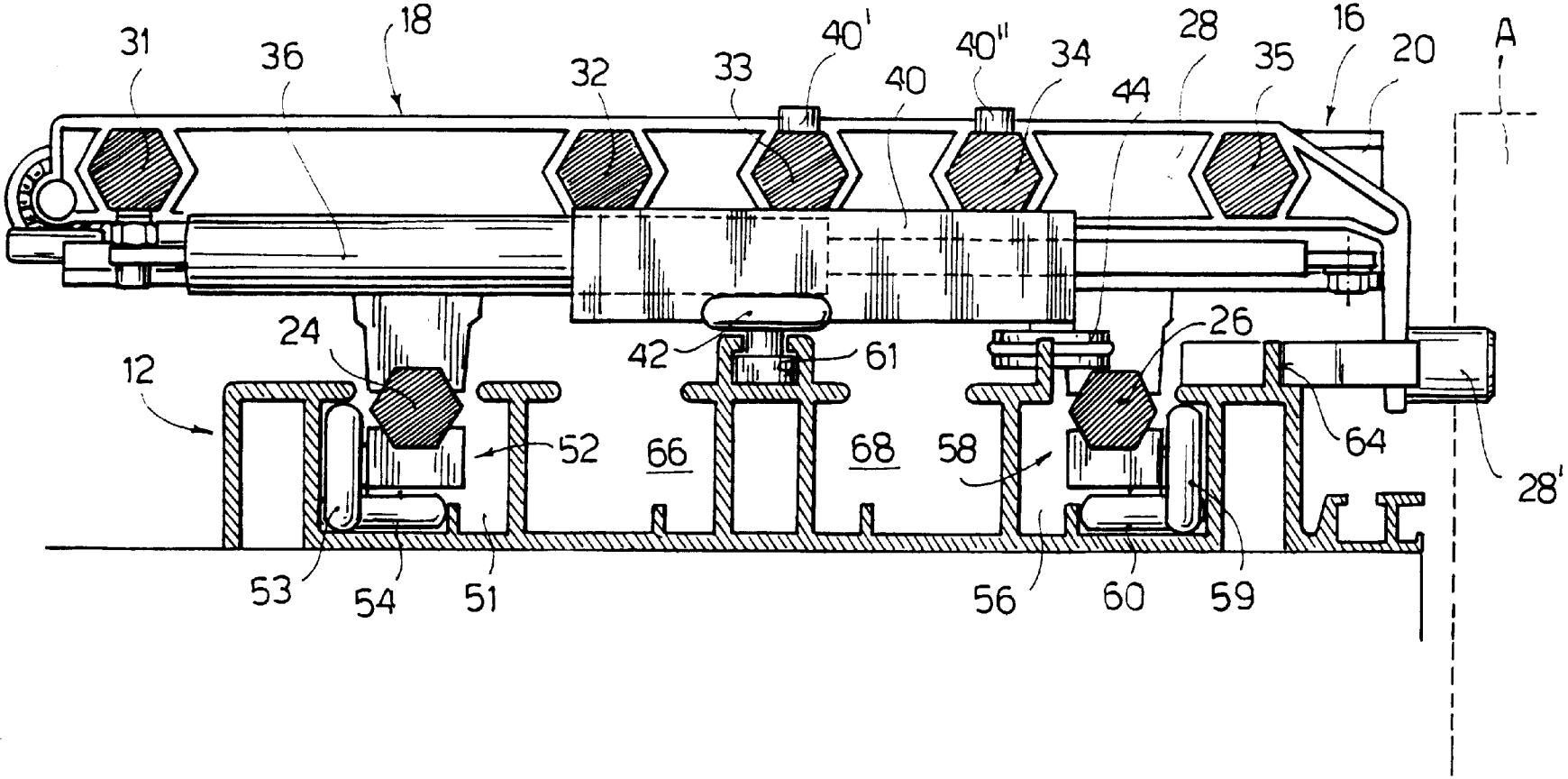
FIG. 3 is a section of the mechanism along the plane indicated by 3—3 in FIG. 1; the mechanism is drawn in the condition with the second slide retracted on the first slide.
Figure 4:
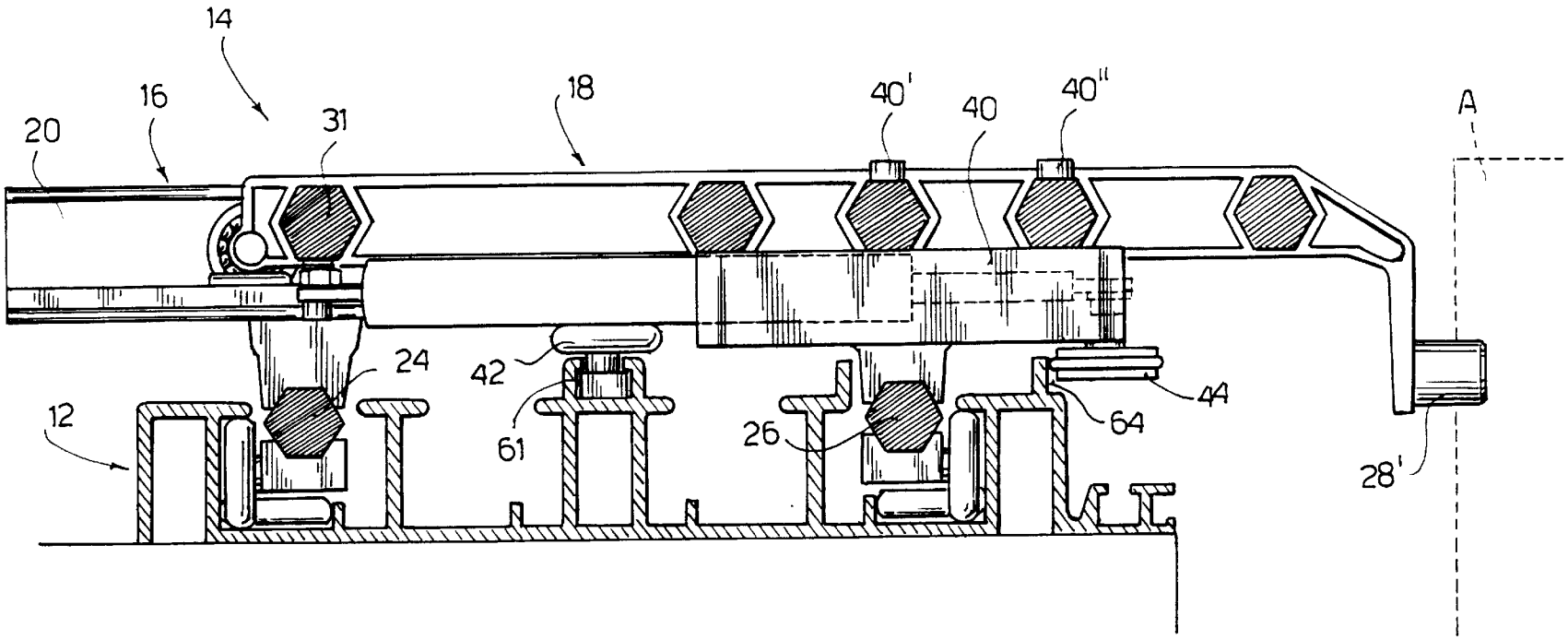
FIG. 4 is a section along the vertical plane 4—4 in FIG. 2, that is a drawing similar to FIG. 3 but illustrating the extended position of the second slide on the first slide.
Figure 5:
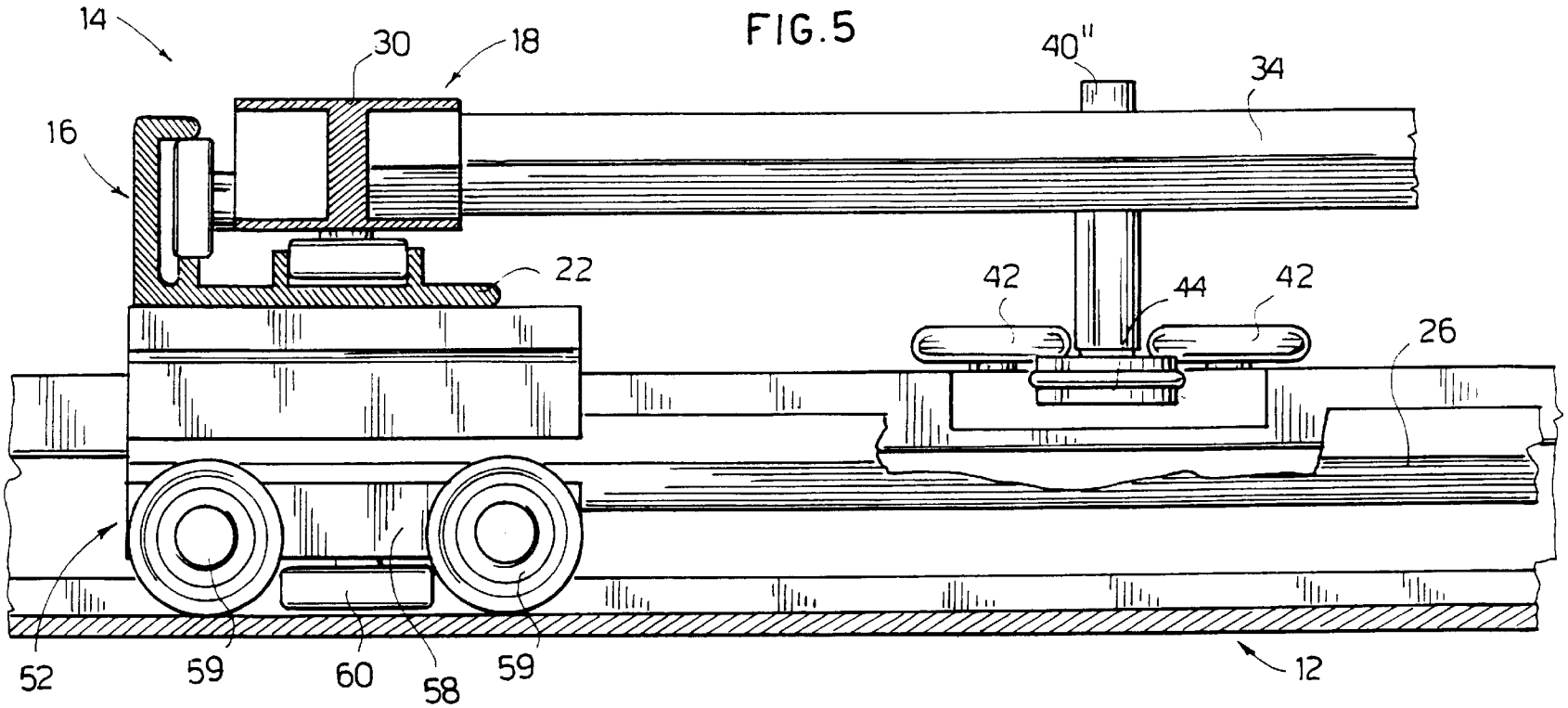
FIG. 5 is a section along 5—5 in FIG. 1.
Figure 6:
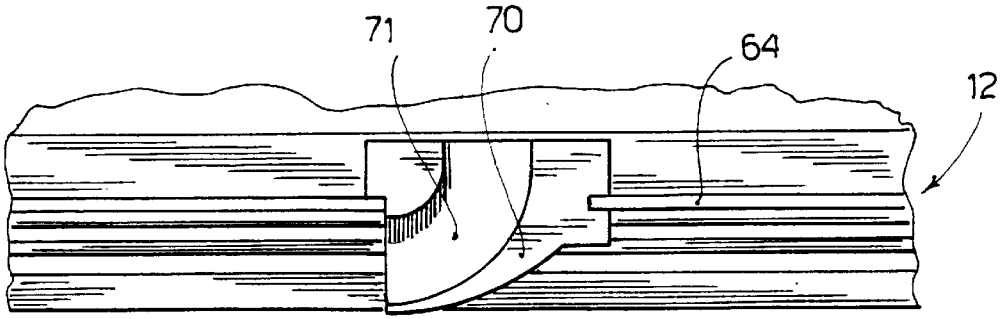
FIG. 6 shows a variant of the deflector element with respect to that illustrated in the preceding figures.

In FIG. 3 a section can be seen through the rail 12 which, in its currently preferred embodiment, used for the mechanisms situated at the top of the wardrobe, comprises a first running track 51, in which a pair of rear carriages 52 of the first slide engages, said carriages being provided with wheels 53 and 54, respectively. The rail also comprises a second running track 56 in which carriages 58 of the first slide, provided with wheels 59, 60, engage to guide the movement along the rail. The locking wheels 42 are mounted in a special groove 61 of the rail. At the front the rail has at least one surface or longitudinal guide tongue 64 designed to be engaged by the guide wheel 44 when the slide 18 is in the extracted position, that is for opening of the door. The section 12 can comprise further seats indicated by 66, 68. These seats can be designed to accommodate further guide carriages for the slide assembly, or preferably one or more balancing bars for the door, constrained to the first slide as will be stated below.

Figures 9A, 9B, 9C:
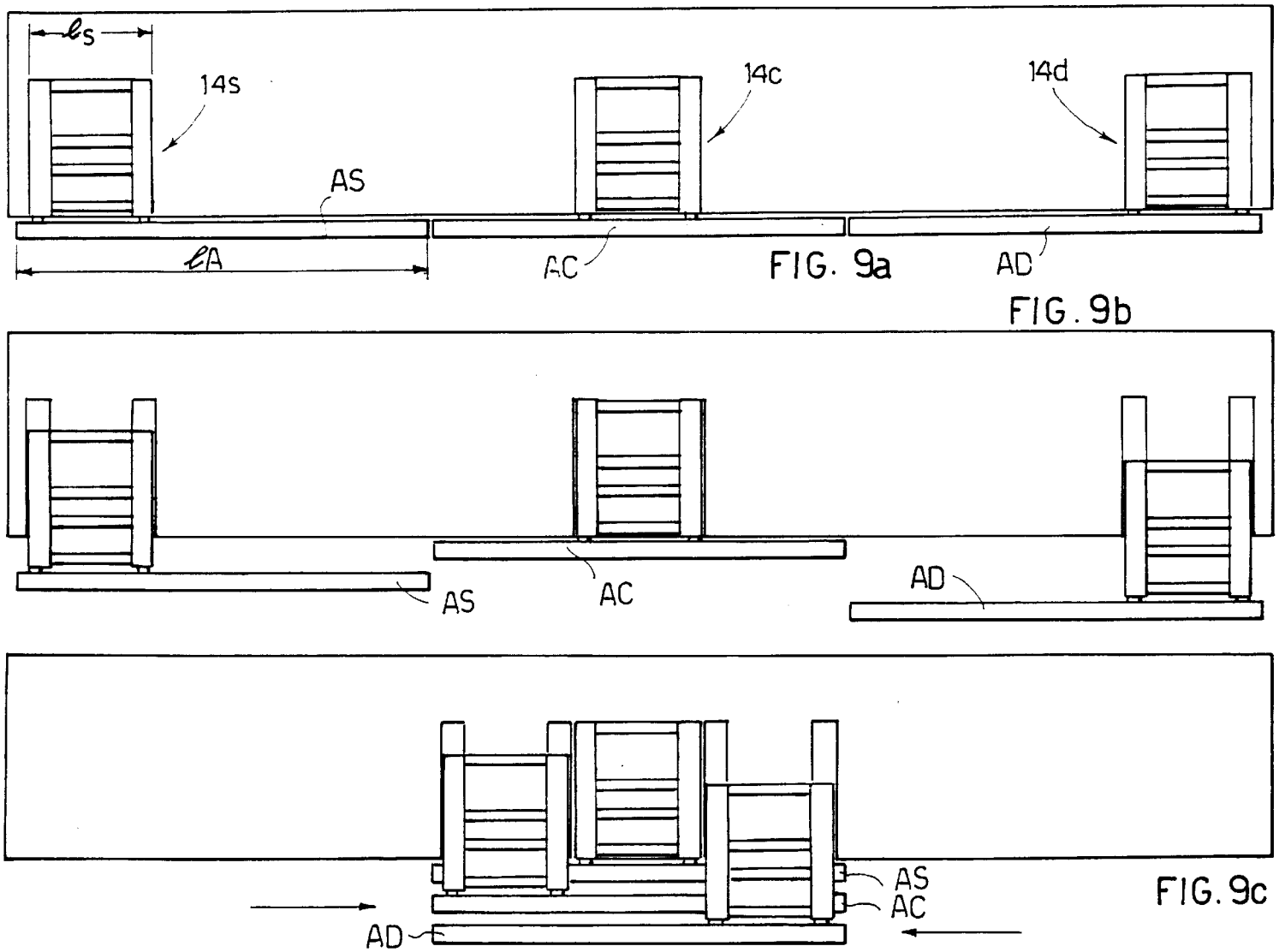
FIGS. 9*a* to 9*e* show a schematic plan view of a wardrobe with three coplanar doors, provided with the mechanism according to the invention; the wardrobe is illustrated in a position with the doors closed (a), with the doors extracted but not yet opened (b), with the doors open and stacked one in front of the other according to a first manner of opening (c), with the doors open and stacked one in front of the other according to a second manner of opening (d) and with the doors stacked oen infront of the other according to a third manner of opening (e)
Figure 9D:
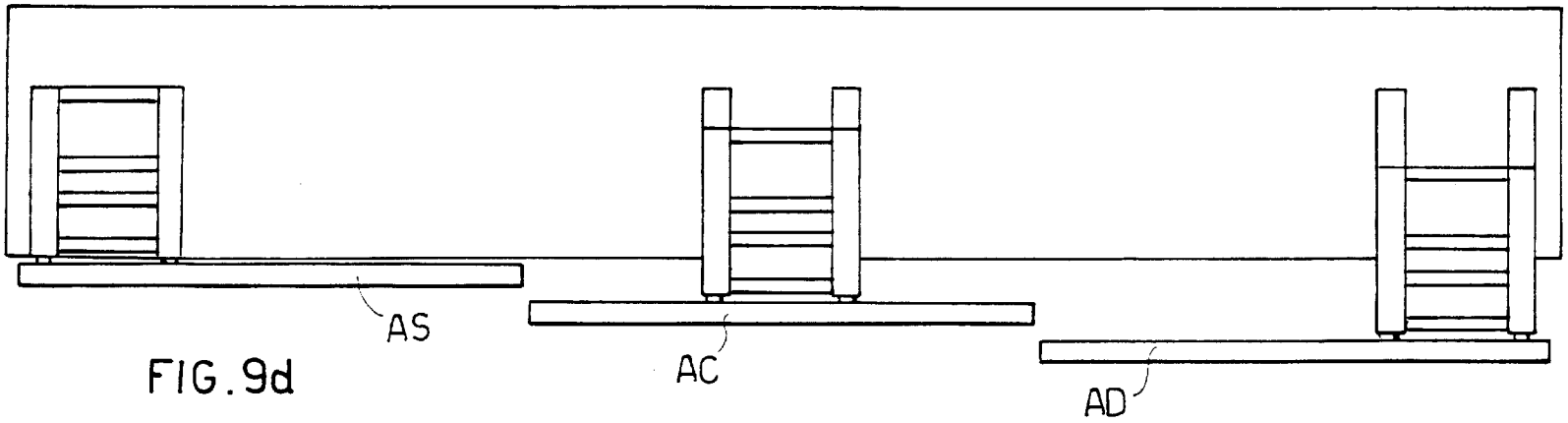
Figure 9E:
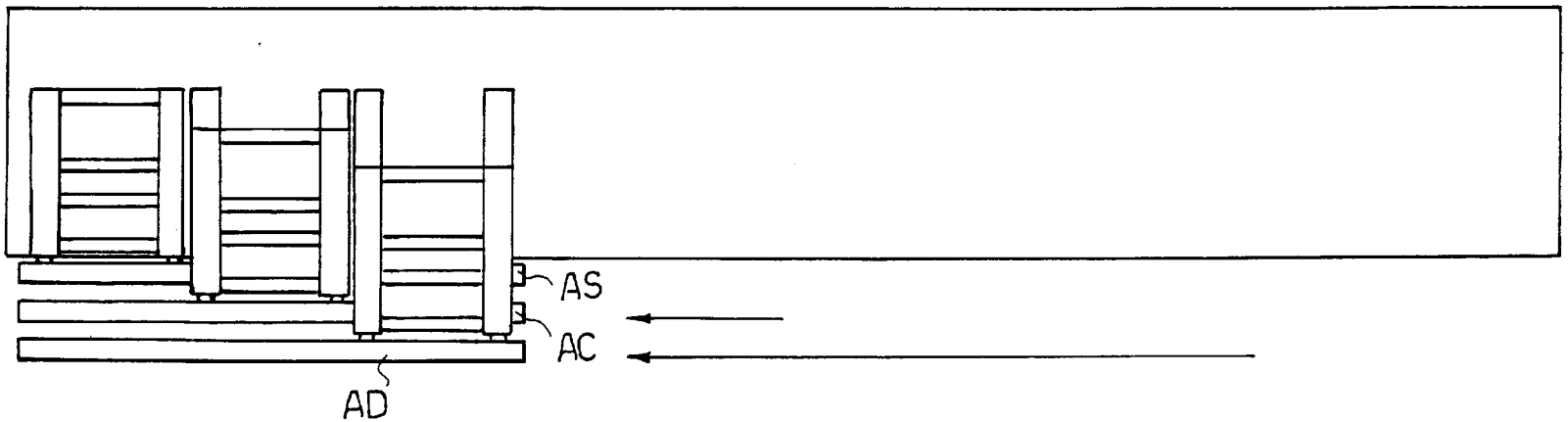

According to an important characteristic of the invention, the width $l_S$ of the slide assembly, marked in FIG. 9, is much smaller than the total width of the door $l_A$ and is preferably a submultiple thereof; for example $l_S=1/2\,l_A$ or $l_S=1/3\,l_A$ or $l_S=1/4\,l_A$ approximately. The slide assembly can be mounted in a central position on the respective door, or in a lateral position thereon; in either case it may be appropriate for the slide assembly to carry a so-called balancing bar which is generally made as an extension of one of the transverse bars, for example 26 in FIG. 1; the balancing bar will therefore be indicated by 26*e*.

At each position provided with locking wheels 42, 42 the tongue 64 of the rail section is interrupted sufficiently for the wheel 44 to pass. A deflector device 70 is preferably mounted at said interruption, this device having a channel 71 with a bend, that can be to the right or the left, or a double bend, suitable for deflecting the wheel 44 in one or other chosen direction.

Moreover, the slide 16 and the slide 18 preferably have locking means to prevent complete extraction of the slide 18 from 16; these means are not illustrated here because they are accessible to an expert in the field.

Operation of the mechanism will now be briefly described.

In the closing position, with slide 18 retracted onto slide 16, the door A is held against the edges of the wardrobe compartment by the action of the spring 36. The door and/or the edges of the wardrobe are generally provided with seals which are thus pressed for tight closure. For opening, the operator first pulls the door in the direction of the arrow F1 (FIG. 1); this makes the second slide 8 slide on the first slide 16 against the action of the spring 36 until it engages the wheel 44 in the channel 71, at the same time disengaging the stop 40 from the position between the two locking wheels 42. At this point the door, moved away from the surface of the wardrobe, can be made to slide in the direction indicated by the arrow F2, in order to open free the wardrobe compartment. For closing the inverse maneuver is carried out, making the door slide in its plane firstly in the direction of the arrow $F'_2$ until it engages the wheel 44 in the deflector device 70, after which the spring 36 causes the second slide 18 to return onto the first slide 16 in the direction of the arrow F'1. In the case of a wardrobe with two doors, the two coplanar doors will be mounted in exactly the same manner, with the sole precaution of mounting a deflector device 70 specular to the other for each of the doors.

In this manner, whichever of the doors is to be opened, it can be done easily with exactly the same extracting and sliding movement both for the right-hand and for the left-hand door.

It should be noted that each door will preferably be suspended on a mechanism like that described at the top and will preferably be provided with a similar or preferably simplified mechanism at the bottom. For example a bottom mechanism can comprise a rail comprising only the sliding tracks 56, 68 although it is still possible to use a mechanism identical to that at the top.

Figure 7:
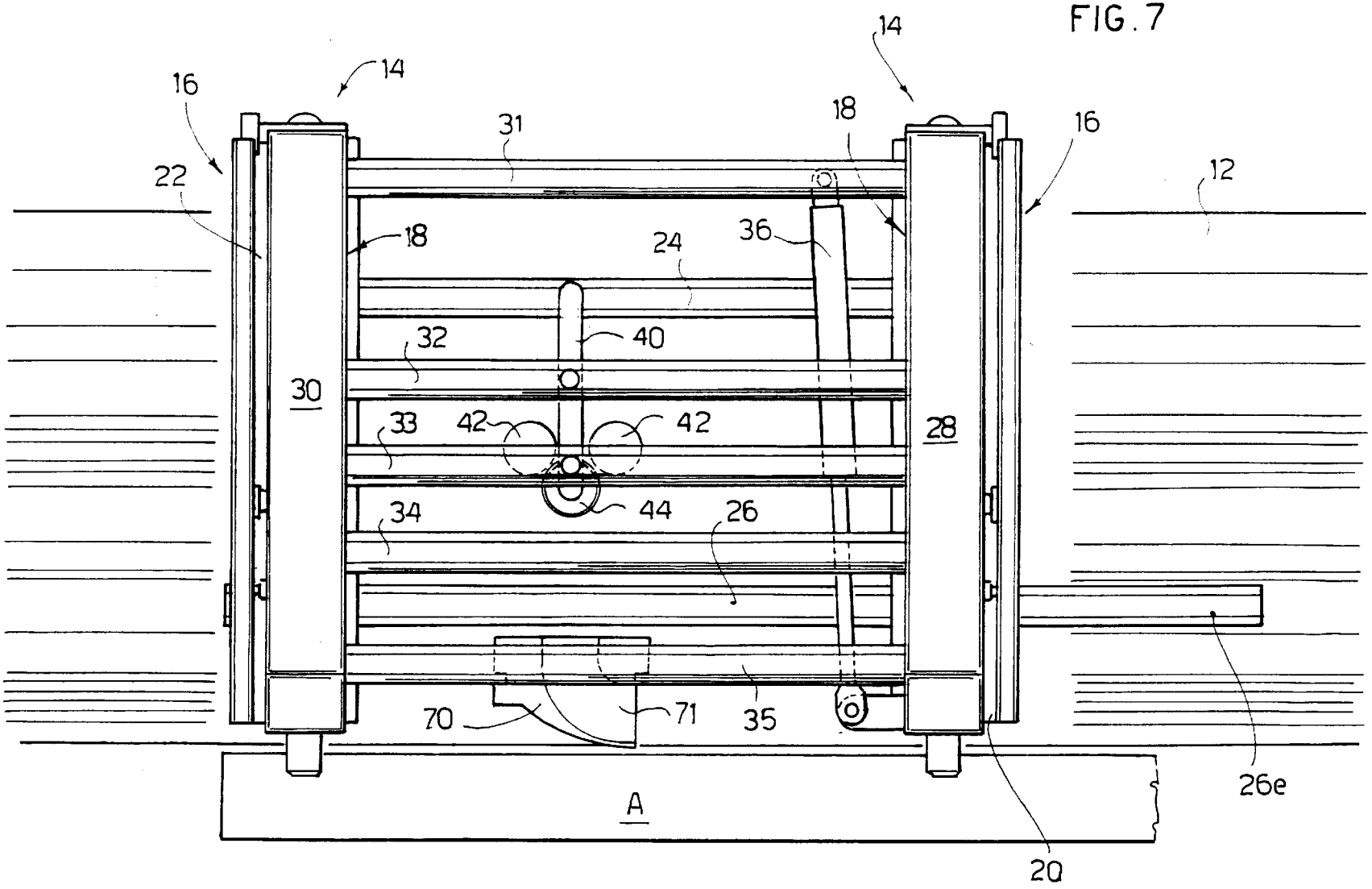
FIGS. 7 and 8 show a plan view of a slide assembly in which the lock/guide wheel assembly has been set for a double pitch outward movement of the second slide on the first slide, that is for an outward movement equal, in the extracted condition, to approximately the thickness of two doors.
Figure 8:
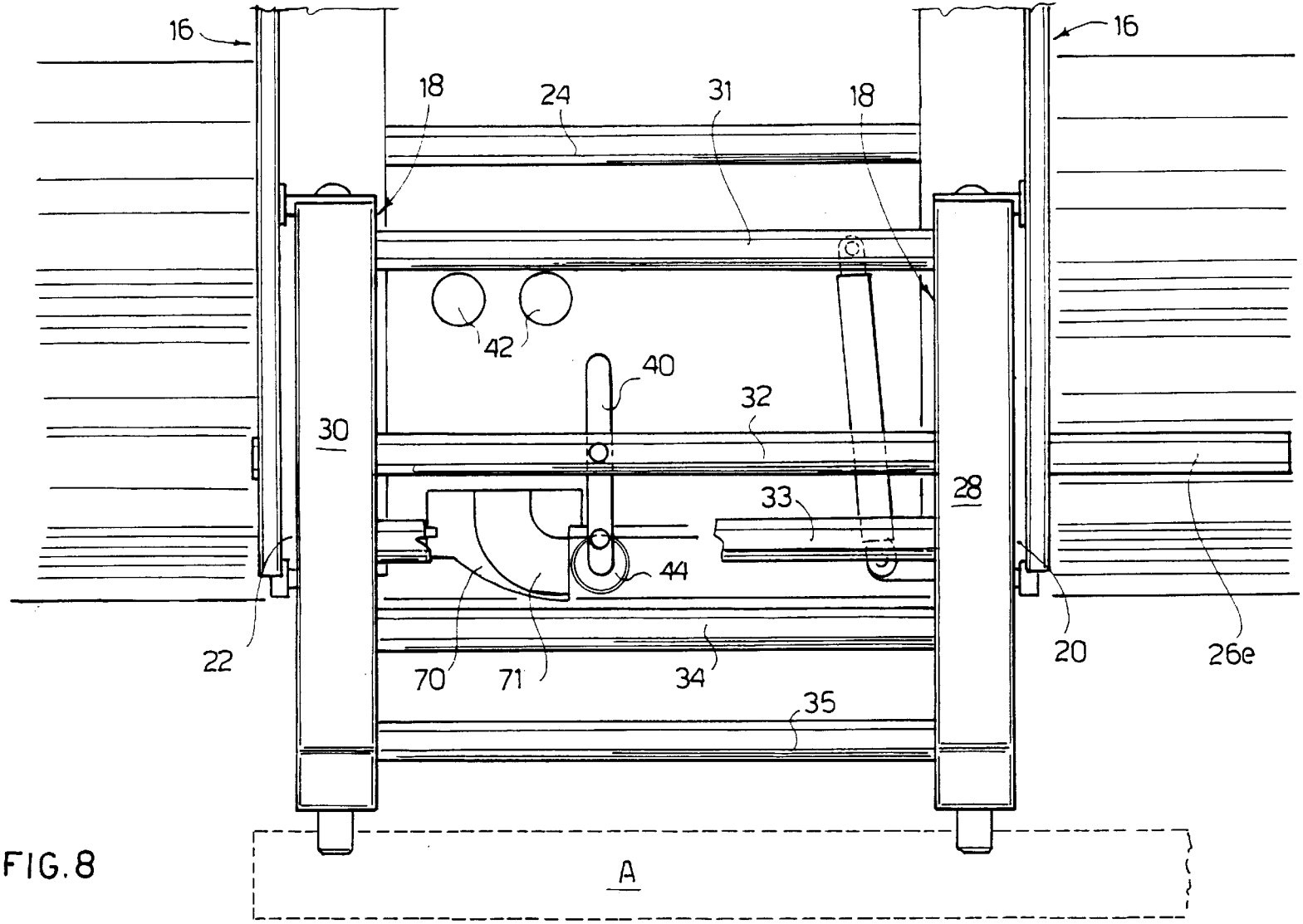

In the case of a wardrobe with three doors, for example, it will be useful to have a door that can be extracted for a double pitch with respect to the others. This is achieved with an identical mechanism, with the precaution, for the slide assembly of the third door, of mounting the locking strip 40 and the guide wheel 44 shifted one pitch transversally to the rails with respect to what is shown in FIG. 1. This can easily be done by unscrewing the screws 40', 40" and mounting the device 40 on the bars 32 and 33 instead of on 33 and 34, as shown in FIGS. 7 and 8. The slide assembly 14*a* in FIGS. 7 and 8, when an opening force is applied to it in the direction of the arrow F1, moves until it engages the wheel 44 in the deffector 71; thus in this case it moves two pitches instead of one. Operation of the device is otherwise identical to that described previously.

A door with a movement of a double pitch is useful, for example, in a wardrobe with three doors, as is shown in FIG.

9. With reference to these figures the particular versatility of the mechanism according to the invention will be appreciated.

FIG. 9 is a schematic plan view of a wardrobe with three coplanar doors, each of the doors being equipped with a slide assembly of the mechanism according to this invention. The assembly is mounted on the left of the door for the left-hand door $A_S$ on the left, in the centre for the central door $A_C$ and on the right for the right-hand door $A_D$. The assemblies $\mathbf{14}_S$ for the door $A_S$, $\mathbf{14}_C$ for the door $A_C$ and $\mathbf{14}_D$ for the door $A_D$ can slide on the rail, not illustrated. The assemblies $\mathbf{14}_S$ and $\mathbf{14}_C$ are of the type illustrated in FIG. 1, that is to say arranged for a single-pitch extraction, the assembly $\mathbf{14}_D$ is of the type illustrated in FIGS. 7 and 8, that is to say arranged for a double-pitch extraction. It will be seen that the operator, with an identical maneuver, that is to say pulling each door towards himself and then pushing said door sideways, is able to carry out the following operations:

leaving the central compartment closed by the central door $A_C$, open the left-hand compartment by making the door $A_S$ slide over the door $A_C$ and open the right-hand compartment by making the door $A_D$ also slide over the door $A_C$ as illustrated in FIGS. 9*b* and 9*c*; or leaving the left-hand compartment closed and the left-hand door $A_S$ still, make the central door $A_C$ slide on the door $A_S$ and the right-hand door $A_D$ on the doors $A_S$ and $A_C$ thus at the same time freeing the central compartment and the right-hand compartment of the wardrobe (FIGS. 9*d, e*).

Figure 10A:
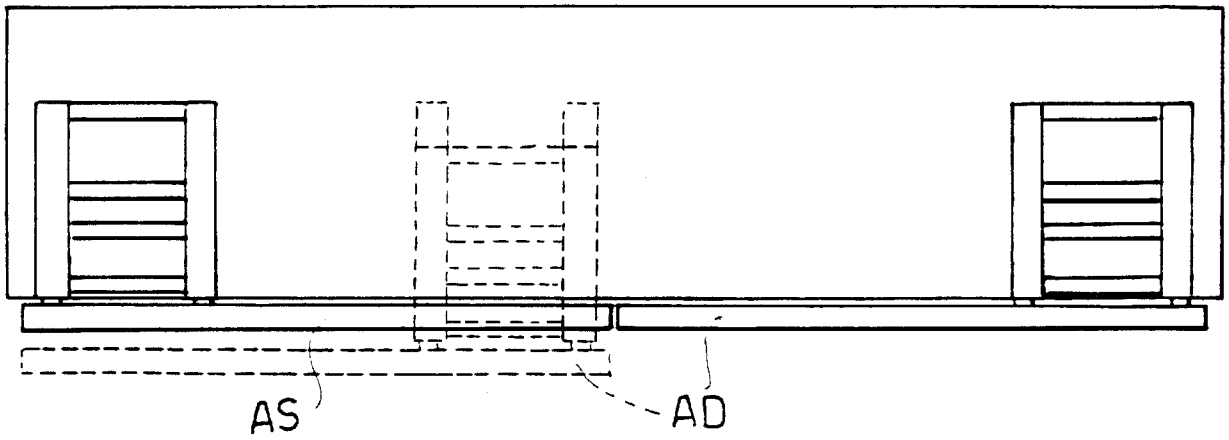
FIGS. 10*a*–*b* show a wardrobe with two doors, in a first manner of opening (a), and in a second manner of opening (b).
Figure 10B:
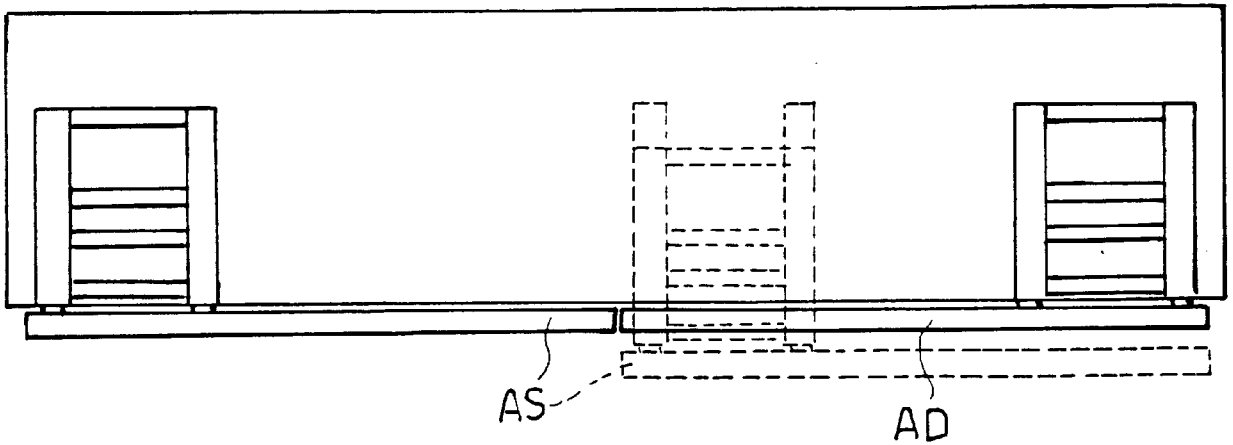

Obviously it is also possible to open a single compartment alone, with an identical maneuver on each respective door; for example it is possible to open the left-hand compartment by pulling out the door $A_S$ and sliding it over the door $A_C$; the central compartment can be opened by pulling out the door $A_C$ and sliding it over the door $A_S$ or the door $A_D$; the right-hand compartment can be opened by pulling out the door $A_D$ and sliding it over the door $A_C$. In the case of a wardrobe with two doors (FIGS. 10*a, b*), one or the other door without distinction can be pulled out and positioned on top of the other. It is not necessary, therefore, for the operator to remember that he has to act differently for one or the other door, as is necessary with conventional systems.

Obviously changes and modifications can be made to what has been described, it being understood that all changes and modifications accessible to an expert in the field with a normal degree of experience come within the scope of the present invention.

We claim:

1. An assembly comprising a mechanism opening and closing at least one sliding door adapted to be mounted on a stationary structure, particularly a furniture structure, to open and respectively close an aperture/apertures of said structure, comprising:

a rail (12) adapted to be mounted on said structure;

a slide assembly (14) linked to said sliding door, and engaged with said rail to slide therealong;

said slide assembly (14) comprising a first slide (16) longitudinally movable on said rail and a second slide (18) carried on said first slide (16) and slidable thereon transversely of said rail, between an extracted opening position and a retracted closing position and vice versa; said second slide being linked to said door;

an elastic return system (36) between said first slide and said second slide to force said second slide to the retracted position;

cooperating guide means (64, 66) on said rail and said second slide to guide the longitudinal movement of the slide assembly when the second slide is in the extracted position;

locking means (40, 42) to stop the longitudinal movement of said slide assembly on said rail, when said second slide is in the retracted position.

2. The assembly according to claim 1 wherein the width ($l_S$) of said slide assembly is less than the width ($l_A$) of the door.

3. The assembly according to claim 2 wherein the width of said slide assembly is a submultiple of the width of the door.

4. The assembly according to claim 1 wherein said guide means for sliding of the slide assembly comprise a longitudinal tongue (64) on the rail on which a wheel (44) integral with the second slide engages, when said second slide is in the extracted position.

5. The assembly according to claim 4 wherein said tongue (64) has an interruption corresponding to a position of extraction for the second slide and, level with said interruption, the mechanism further comprises a deflector device (70) mounted interchangeably and comprising a channel (71) forming a bend.

6. The assembly according to claim 5, wherein said strip (40) also carries a guide wheel (44) for the longitudinal movement.

7. The assembly according to claim 6 wherein said strip (40) and wheel (44) are mounted on the second slide to allow the second slide to be extracted with respect to the first by multiple amounts each corresponding to a pitch approximately the thickness of a door.

8. The assembly according to claim 1, wherein said locking means comprise a strip (40) constrained to said second slide that enters a space between locking wheels (42) mounted on the rail.

9. The assembly according to claim 1 wherein the first slide comprises balancing bars (26*e*) accommodated inside special seats in the rail.

10. The assembly according to claim 1 wherein the at least one sliding door is a plurality of coplanar doors, said mechanism is situated at the top of said doors and a further said mechanism is situated at the bottom of said doors, the rail of each mechanism being mounted on the structure and the second slide being linked to at least one of the doors.

11. The assembly according to claim 10 comprising two doors, each of said two doors being linked to a respective said slide assembly, and each said slide assembly being set for an outward movement of the second slide not less than the thickness of at least one of the doors.

12. The assembly according to claim 10 comprising three doors, wherein the slide assemblies of two of said doors are set for an outward movement not less than the thickness of at least one of the doors and the slide assembly of the third door is set for an outward movement not less than twice the thickness of at least one of said doors.

* * * * *